US008065754B2

(12) United States Patent
Johnson et al.

(10) Patent No.: US 8,065,754 B2
(45) Date of Patent: Nov. 29, 2011

(54) POLE PLUNGER

(76) Inventors: Carlos J. Johnson, District Heights, MD (US); Robert Dreher, Ft. Washington, MD (US)

( * ) Notice: Subject to any disclaimer, the term of this patent is extended or adjusted under 35 U.S.C. 154(b) by 1339 days.

(21) Appl. No.: 11/288,329

(22) Filed: Nov. 29, 2005

(65) Prior Publication Data

US 2007/0118980 A1 May 31, 2007

(51) Int. Cl.
*E03D 9/00* (2006.01)

(52) U.S. Cl. ..... 4/255.01; 4/255.11

(58) Field of Classification Search ..... 4/255.01, 4/255.11

See application file for complete search history.

(56) References Cited

U.S. PATENT DOCUMENTS

| | | | | |
|---|---|---|---|---|
| 2,608,695 | A | 9/1952 | Skibowski | |
| 3,994,032 | A | 11/1976 | Spickofsky | |
| 4,458,368 | A | 7/1984 | Webb | |
| 5,353,442 | A * | 10/1994 | Rotter | 4/255.11 |
| 5,522,094 | A | 6/1996 | Balazs | |
| 5,617,605 | A | 4/1997 | Hoerner | |
| D404,178 | S | 1/1999 | Wetzler | |
| D406,930 | S | 3/1999 | Epps | |
| 6,067,668 | A | 5/2000 | Rudd | |
| 6,145,135 | A | 11/2000 | Pool | |
| 6,374,427 | B1 | 4/2002 | Tash | |
| 6,550,074 | B1 | 4/2003 | Allenbaugh | |
| 6,618,873 | B2 | 9/2003 | Mulgrew | |
| 6,634,035 | B1 | 10/2003 | Fletcher | |
| D495,841 | S | 9/2004 | Smith | |
| 2001/0037522 | A1 | 11/2001 | Pool | |
| 2003/0079278 | A1 | 5/2003 | Tash | |
| 2004/0064878 | A1 | 4/2004 | Walsh | |

FOREIGN PATENT DOCUMENTS

| | | |
|---|---|---|
| EP | 0233961 A1 | 9/1987 |
| GB | 2036236 | 6/1980 |

* cited by examiner

*Primary Examiner* — Tuan N Nguyen
(74) *Attorney, Agent, or Firm* — Richard C. Litman

(57) ABSTRACT

The pole plunger includes a main shaft having an upper disc secured to an upper end and a lower disc secured to a lower end. The lower disc has a radius greater than that of the upper disc, allowing the user to select the appropriately sized disc which matches the radius of a drain pipe to be plunged. Additionally, a handle portion may be secured to the main shaft, extending in a direction orthogonal thereto, providing the user with a handle to grip during the plunging process. The handle portion further has a handle disc secured to its free end, with the handle disc having a radius between that of the upper and lower discs, providing the user with a third size disc for plunging of the drain pipe.

9 Claims, 3 Drawing Sheets

POLE PLUNGER

BACKGROUND OF THE INVENTION

1. Field of the Invention

The present invention relates to a pole plunger having plunging discs secured to opposed ends of a main shaft, with the discs having different radii, allowing the user to select the appropriate disc to match the radius of a drainage pipe to be plunged. Further, a handle portion may be secured to the main shaft, with a third disc having a third unique radius being secured to the free end thereof.

2. Description of the Related Art

Various configurations of plungers have been developed and used for unclogging sinks, toilets and drainage pipes. Typical plungers include a shaft having a plunging bell or disc secured to the lower end. The bell or disc is placed in the sink, toilet or drainage pipe, and the user moves the shaft in an alternating up-and-down fashion, to break up clogging waste, either through direct contact or through variations in water pressure. Though bells and discs for these plungers are generally flexible and deformable, they typically are only adapted for drains having a single radius, or a set of radii within a very limited range. In order to clear pipes and drains of different sizes and contours, a plurality of these typical plungers would be needed. It would be desirable to provide a plunger offering multiple plunging discs having a variety of radii, which could be selected by the user dependent upon the size of the drainage pipe or other conduit.

Further, the user grips a typical plunger only by the shaft. If a handle portion is provided, it is typically mounted to the upper end of the shaft and formed as a knob-like structure. Since the user moves the shaft in an up-and-down fashion in operation, in a direction parallel to that of the shaft, this does not provide a secure grip on the plunger. It would be preferable to provide a handle mounted in a lateral direction, which the user could easily grasp and operate.

None of the above inventions, taken either singly or in combination, is seen to describe the instant invention as claimed. Thus, a pole plunger solving the aforementioned problems is desired.

SUMMARY OF THE INVENTION

The pole plunger includes a main shaft having an upper disc secured to an upper end thereof and a lower disc secured to a lower end thereof. The main shaft is generally tubular and may be formed of steel pipe or similar materials. The upper and lower discs are planar rubber members having substantially circular contours, adapted for clearing blockages within drainage pipes. The lower disc has a radius greater than that of the upper disc, allowing the user to select the appropriately sized disc which matches the radius of the drain pipe to be plunged.

Additionally, a handle portion may be secured to the main shaft, extending in a direction orthogonal thereto, providing the user with a handle to grip during the plunging process. The handle portion further has a handle disc secured to its free end, with the handle disc having a radius between that of the upper and lower discs, providing the user with a third size disc for plunging of the drain pipe.

The main shaft is formed from an upper portion and a lower portion, and the handle portion, upper portion and lower portion may all be releasably secured to one another through use of a connector, allowing the user to interchange the handle portion, upper portion and lower portion, depending on the user's needs and the dimensions of the drainage pipe to be plunged. Each of the upper, lower and handle portions may further have a different length.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
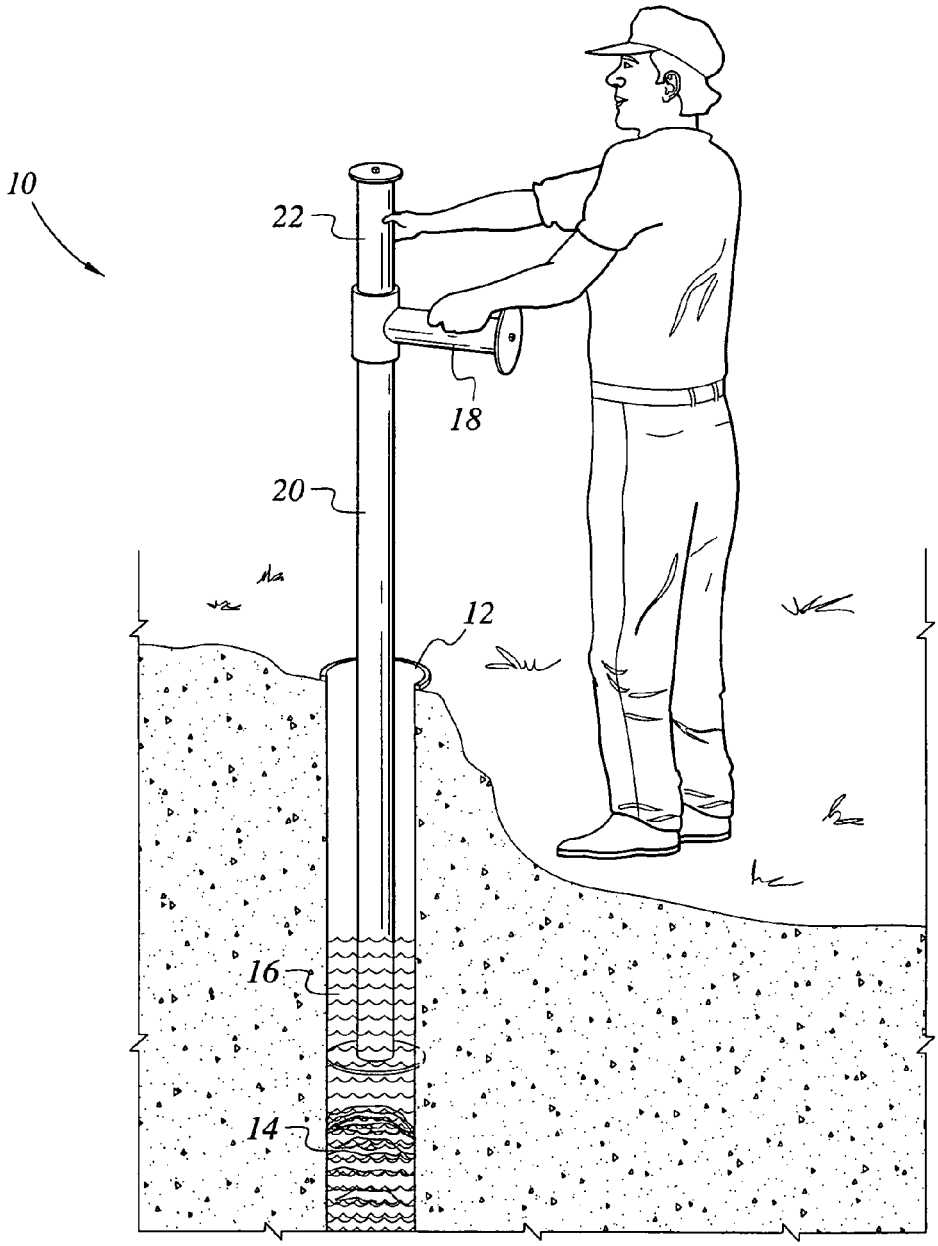
FIG. 1 is an environmental, perspective view of a pole plunger according to the present invention.
Figure 2:
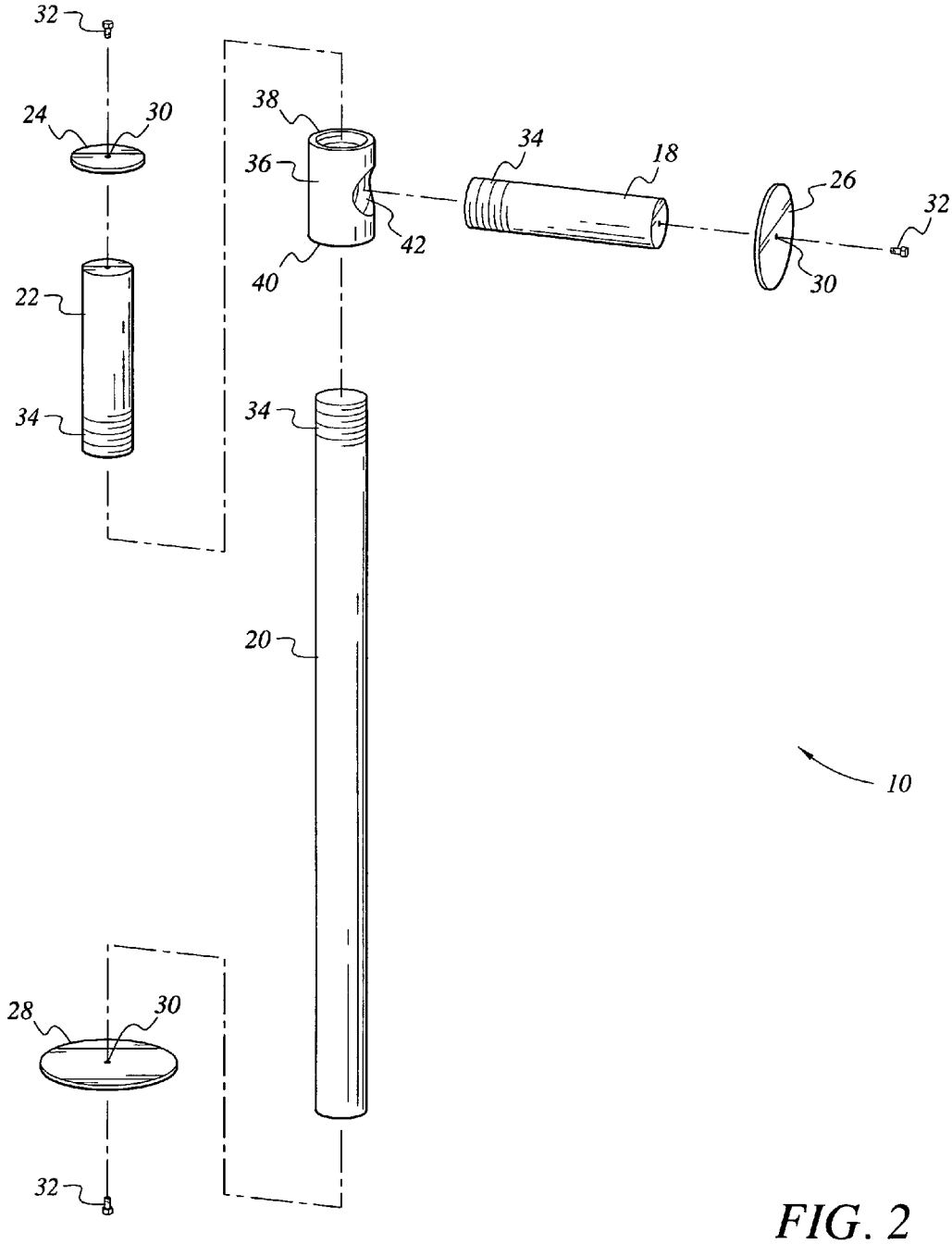
FIG. 2 is an exploded view of the pole plunger according to the present invention.

As shown in FIGS. 1 and 2, the pole plunger 10 of the present invention includes an upper shaft portion 22 and a lower shaft portion 20, with the lower shaft portion 20 being placed within a drainage pipe 12, which is to be unclogged by the user. As will be described in further detail below, a lower plunging disc 28 is secured to the lower end of lower shaft portion 20, and the user-driven up-and-down motion of the plunging disc 28 within drainage pipe 12 causes blockage 14 to break up, either through direct contact therewith, or through induced variations in the pressure of water 16.

As best shown in FIG. 2, an upper plunging disc 24 is secured to an upper end of upper shaft portion 22, and lower plunging disc 28 is similarly secured to the lower end of lower shaft portion 20. Each of the plunging discs 24, 28 is formed from a resilient material, such as rubber, and has a substantially circular contour. Each of plunging discs 24, 28 has an opening 30 formed centrally therethrough, for receiving a fastener, such as, for example, a bolt 32, in order to secure plunging discs 24, 28 to upper and lower shaft portions 22, 20, respectively.

Lower plunging disc 28 has a diameter greater than that of upper plunging disc 24. Though the size of each plunging disc is dependent upon the needs and desires of the user, in the preferred embodiment, the upper plunging disc 24 has a diameter of approximately 2 inches and the lower plunging disc has a diameter of approximately 4 inches. Thus, the user may select the appropriately sized one of plunging discs 24, 28 dependent upon the size of the drainage pipe to be plunged.

Additionally, a handle portion 18 is provided. Upper shaft portion 22 and lower shaft portion 20 form a tubular shaft extending in the longitudinal direction. Handle portion 18 is secured to the tubular shaft at a distal end thereof, and projects outwardly from the tubular shaft along a lateral axis orthogonal to the longitudinal direction. The upper shaft portion 22, the lower shaft portion 20 and the handle portion 18 are formed from a structurally strong and versatile material, such as steel pipe.

Further, a handle plunging disc 26 is secured to the proximal end of handle portion 18. Handle plunging disc 26 is similar in structure to upper and lower plunging discs 24, 28, and is secured to the proximal end of handle portion 18 through reception of fixture 32 by opening 30, with fixture 32 engaging the proximal end of the handle portion 18. In the preferred embodiment, handle plunging disc 26 has a diameter of approximately 3 inches, providing the user with a plunging disc appropriate for a third size range of drainage pipes.

Upper shaft portion 22, lower shaft portion 20 and handle portion 18 may be joined together by the use of connector 36, as shown in FIG. 2. Connector 36 has a generally tubular contour with an upper opening 38, a lower opening 40 and a side opening 42 formed through the side wall, as shown. Each of the openings 38, 40 and 42 may be threaded, allowing for selective releasable engagement with the threaded ends 34 of upper shaft portion 22, lower shaft portion 20 and handle portion 18, respectively.

Each of the upper shaft portion 22, lower shaft portion 20 and handle portion 18 may have a different length associated therewith. Though the lengths of each portion are dependent upon the needs and desires of the user, in the preferred embodiment, the upper shaft portion 22 has a length of approximately 7 inches, the lower shaft portion 20 has a length of approximately 36 inches and the handle portion has a length of approximately 7 inches. Thus, the user may selectively arrange the portions 22, 20 and 18 with respect to connector 36 and with respect to one another dependent upon the length of portion and diameter of plunging disc necessary for a particular drainage pipe 12 or blockage 14.

Figure 3:
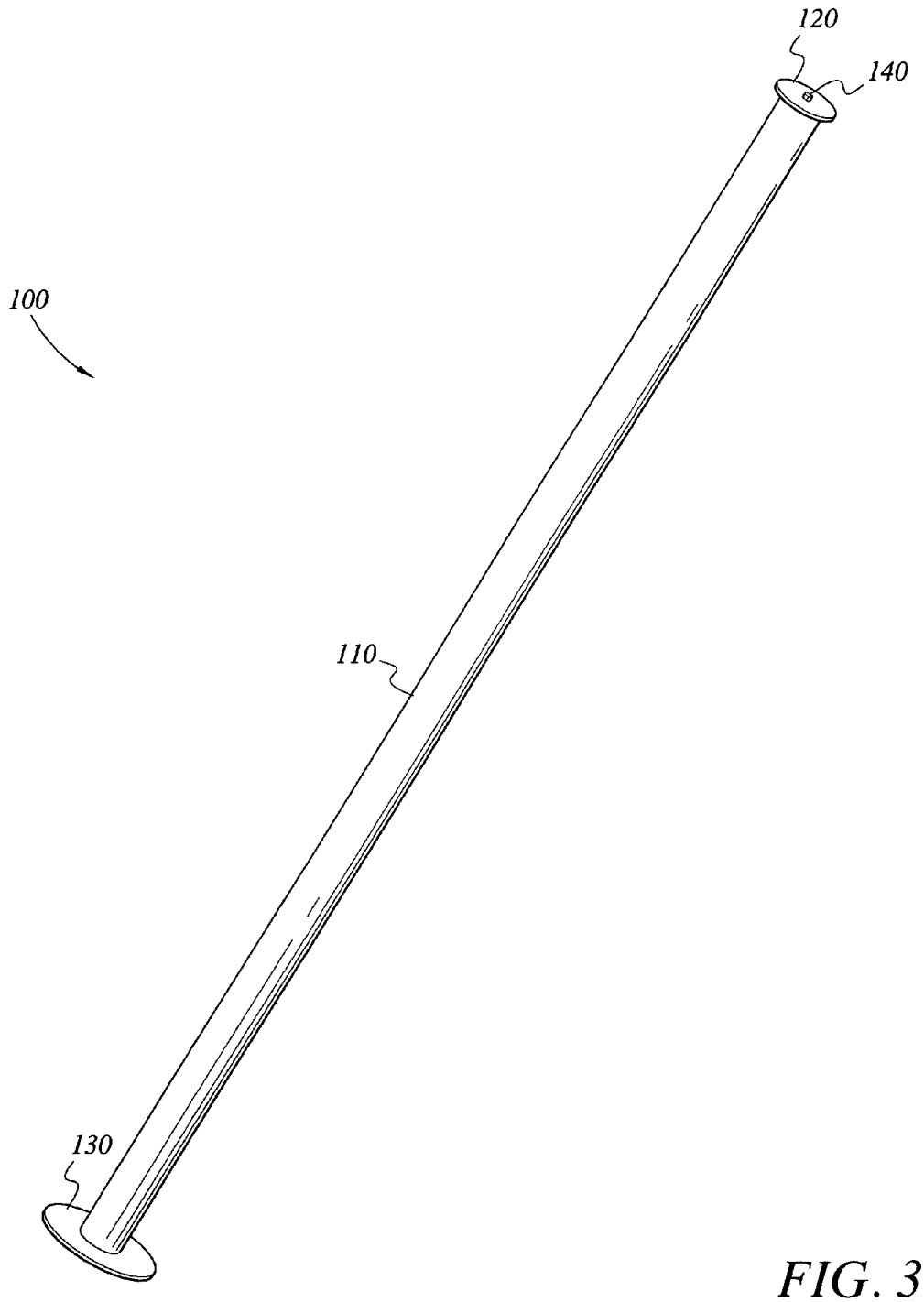
FIG. 3 is a perspective view of an alternative embodiment of the subject pole plunger of the present invention.

In the alternative embodiment of FIG. 3, the pole plunger 100 is similar in design to that of FIGS. 1 and 2, however, pole plunger 100 does not include a handle portion. The separable upper and lower shaft portions of FIGS. 1 and 2 are replaced in the embodiment of FIG. 3 by a continuous one-piece shaft 110. The length of shaft 110 is dependent upon the needs and desires of the user, however, in the preferred embodiment, shaft 110 is approximately 54 inches long.

An upper plunging disc 120 is secured to an upper end of shaft 110 by a fixture 140, and a lower plunging disc 130 is secured to the lower end of shaft 110 by a similar fixture 140, in a manner similar to that of the embodiment of FIGS. 1 and 2. Though the sizes of plunging discs 120 and 130 are dependent upon the needs and desires of the user, in the preferred embodiment, upper plunging disc 120 is approximately 2 inches in diameter and lower plunging disc 130 is approximately 3 inches in diameter.

It is to be understood that the present invention is not limited to the embodiments described above, but encompasses any and all embodiments within the scope of the following claims.

We claim:

1. A pole plunger, comprising:

a main shaft having opposed upper and lower ends and extending in a longitudinal direction, said main shaft having an upper portion and a lower portion;

an upper disc mounted on said upper end of said main shaft, said upper disc having an upper radius associated therewith, said upper disc defining an upper plane, said upper plane being substantially orthogonal to said longitudinal direction;

a lower disc mounted on said lower end of said main shaft, said lower disc having a lower radius associated therewith, said lower disc defining a lower plane, said lower plane being substantially orthogonal to said longitudinal direction, said lower radius being greater than said upper radius, whereby a user may selectively match said upper radius or said lower radius to a radius of a drain pipe to be plunged with said pole plunger, the user inserting the selected one of said upper or lower discs into said drain pipe;

a handle portion having opposed proximal and distal ends, said distal end being releasably mounted to said main shaft, said handle portion extending in a lateral direction substantially orthogonal to said longitudinal direction, a handle disc mounted on said proximal end of said handle portion, said handle disc having a handle radius associated therewith, said handle disc defining a handle plane, said handle plane being substantially orthogonal to said lateral direction; and, a connector, said connector having a substantially tubular contour and extending in said longitudinal direction, said connector having an upper opening, a lower opening and a side opening formed through a side wall thereof, a distal end of said upper portion being releasably received within said upper opening, a distal end of said lower portion being releasably received within said lower opening, said distal end of said handle portion being releasably received within said side opening, wherein the user may selectively interchange the positions of said upper portion, said lower portion and said handle portion with respect to said upper, lower and side openings of said connector.

2. The pole plunger as recited in claim 1, wherein said handle radius is greater than said upper radius and less than said lower radius.

3. The pole plunger as recited in claim 2, wherein said upper portion of said main shaft is releasably secured to said lower portion of said main shaft.

4. The pole plunger as recited in claim 3, wherein said distal ends of said upper portion, said lower portion and said handle portion are threaded.

5. The pole plunger as recited in claim 4, wherein said upper opening, said lower opening and said side opening of said connector are threaded for releasable threaded engagement with said distal ends of said upper, lower and handle portions.

6. The pole plunger as recited in claim 1, wherein said upper portion has an upper length associated therewith and said lower portion has a lower length associated therewith, said lower length being greater than said upper length.

7. The pole plunger as recited in claim 1, further comprising upper, lower and handle bolts, wherein each of said upper, lower and handle discs has an opening formed centrally therethrough, said upper bolt being received by said opening of said upper disc and securing said upper disc to said upper portion, said lower bolt being received by said opening of said lower disc and securing said lower disc to said lower portion, said handle bolt being received by said opening of said handle disc and securing said handle disc to said handle portion.

8. A pole plunger, comprising:

a main shaft having opposed upper and lower ends and extending in a longitudinal direction, said main shaft having an upper portion and a lower portion;

an upper disc mounted on said upper end of said main shaft, said upper disc having an upper radius associated therewith, said upper disc defining an upper plane, said upper plane being substantially orthogonal to said longitudinal direction;

a lower disc mounted on said lower end of said main shaft, said lower disc having a lower radius associated therewith, said lower disc defining a lower plane, said lower plane being substantially orthogonal to said longitudinal direction, said lower radius being greater than said upper radius, whereby a user may selectively match said upper radius or said lower radius to a radius of a drain pipe to be plunged with said pole plunger, the user inserting the selected one of said upper or lower discs into said drain pipe;

a handle portion having opposed proximal and distal ends, said distal end being mounted to said main shaft, said handle portion extending in a lateral direction substantially orthogonal to said longitudinal direction; and a handle disc mounted on said proximal end of said handle portion, said handle disc having a handle radius associated therewith, said handle disc defining a handle plane, said handle plane being substantially orthogonal to said lateral direction.

9. The pole plunger as recited in claim 8, further comprising a connector, said connector having a substantially tubular contour and extending in said longitudinal direction, said connector having at least an upper opening and a lower opening, a distal end of said upper portion being releasably received within said upper opening, a distal end of said lower portion being releasably received within said lower opening, wherein the user may selectively interchange the positions of said upper portion and said lower portion with respect to said upper and lower openings of said connector.

* * * * *